United States Patent [19]

Scheer et al.

[11] Patent Number: 4,872,962

[45] Date of Patent: Oct. 10, 1989

[54] PRINTING PRESS

[75] Inventors: Wolfgang Scheer, Holzkirchen; Hartmut Fuhrmann, Karlsfeld; Gerhard Kossmehl, Berlin; Matthias Niemitz, Berlin; Detlef Kabbeck-Kupijai, Berlin, all of Fed. Rep. of Germany

[73] Assignee: MAN Technologie GmbH, Munich, Fed. Rep. of Germany

[21] Appl. No.: 134,924

[22] Filed: Dec. 18, 1987

[30] Foreign Application Priority Data

Feb. 20, 1987 [DE] Fed. Rep. of Germany ..... 3705439

[51] Int. Cl.[4] ..... C25D 17/00

[52] U.S. Cl. ..... 204/224 R

[58] Field of Search ..... 204/224 R, 228

[56] References Cited

U.S. PATENT DOCUMENTS 2,951,441 9/1960 Wolf ..... 101/462

3,079,859 3/1963 Dalton ..... 204/2

3,422,759 1/1969 Brynko ..... 101/467

3,678,852 7/1972 Feinleib ..... 101/465

*Primary Examiner*—T. M. Tufariello

*Attorney, Agent, or Firm*—Scully, Scott, Murphy & Presser

[57] ABSTRACT

The invention relates to a surface printing press with a printed image carrier having an image thereon corresponding to the matter to be printed on paper or the like. The image on the printed image carrier is in the form of hydrophilic and hydrophobic areas. In order to be able to modify the extents and positions of these areas on the press directly and thus reduce press idle times the printed image carrier is made of a material such as polymer whose said areas may be changed over dotwise between the said hydrophilic and hydrophobic conditions by electrical effects taking place in an electrochemical process with one electrode being formed by the plate cylinder and the counter-electrode being formed by a roller bearinged for rotation in an electrolyte container. One of the two electrodes is in the form of matrix and is operated so as to produce a pattern of dots.

15 Claims, 2 Drawing Sheets

PRINTING PRESS

BACKGROUND OF THE INVENTION

The invention relates to a printing press designed for surface printing using a printing image carrier which has wettable and non-wettable areas in accordance with the image to be printed, there being means which under the control of a computer alter the printing image carrier for modifying the matter to be printed.

In the case of surface printing presses printing image carriers are used which are mounted on a plate cylinder and serve to transfer the image for the printing operation. For this purpose the printing image carrier has two types of area, that is to say water-repelling areas representing the inked parts of the image and water-accepting parts representing non-inked parts of the image.

During the process of printing the printing image carrier is wetted by a dampening unit with wetting fluid such as a mixture of water and alcohol so that the fluid adheres to the ink-free parts of the image on the surface of the printing image carrier. The dampening fluid is thus only displaced by the printing ink subsequently applied to the printing plate or it forms an emulsion with it. The ink applied in this manner to the printing plate is then transferred to the blanket cylinder to the sheet of paper.

Generally, the printing image is produced outside the press on the plate so that time is lost and labor required because the machine has to be stopped for changing the plate. Presently it is possible to use electronically stored data for the production of the plate which contain all the information to be printed.

The European patent No. 101,266 describes a printing press with which such electronically encoded printing information is used in order to directly produce or alter the printing plate located in the press. This means that replacement of the printing plate and the respective idle time of the machine and manual operations on the press not longer occur.

This known printing press is characterized in that the printing image carrier has a hydrophilic surface which is washed by means on the printing press, is coated with a hydrophobic layer and then acted upon by means such as a laser. The modification or re-creation of the printing image carrier only involves a short interruption of the printing operation in which the washing, coating and laser devices are operative so that the ink layer is washed off and the hydrophobic layer is renewed, which is then locally removed with the laser beam in accordance with the matter to be printed. The laser beam is modulated with the aid of the encoded print information.

SHORT SUMMARY OF THE INVENTION

One object of the present invention is to provide a general improvement on this type of printing machine.

A further aim of the invention is to provide such a printing press making it possible for the printing image to be simply modified or renewed with means that are simple to manufacture.

In order to achieve these or other objects appearing from the present specification and claims, the printing image carrier comprises a material which is able to be influenced electrically to change it from a hydrophobic condition into a hydrophilic one and the press is provided with a control device adapted to produce electrical control signals for locally influencing the printing image carrier.

This system provides a possibility of producing the printing image on the printing image carrier within the printing press or of changing it without having to stop the press and replace the printing image carrier. The transmission of the encoded printing information in fact may now take place by electrical control of the printing image carrier so that, as compared with the known system, there is a substantial economy in space and a simplification of the method. Furthermore, no expense coating devices and optical systems are required and there is no transfer of material, which then has to be removed from the plate before the image thereon is renewed.

The printing image carrier may be in the form of a foil which is held taut on a plate or on a cylinder, either the entire foil or only its surface layer consisting of the electrically modifiable material. However it is also possible for the printing image carrier to be the surface layer of a cylinder or of a plate, such surface layer for example being applied by coating the plate or cylinder.

The dotwise application of an electric current or electrical field with different polarities causes the modifiable material to be changed into the one or the other condition dot by dot. The sum of the dots in the one condition constitutes the ink receiving part of the image while the sum of the dots in the other condition represents the part of the image free of ink. By reversing the direction of the electrical signal the condition of the respective dot of material in the printing image carrier may be reversed. The control or modification may also however take place electrochemically using a suitable electrolyte.

In accordance with one form of the invention the material is an electrically conductive polymer.

Electrically conductive polymers may be produced by the electrochemical polymerisation of aromatic compounds (that is to say homoaromatic and and heteroaromatic compounds) or of products obtained therefrom by substitution. The result of polymerisation is the production on the anode of flexible, electrically conductive polymer films, which contain positively charged polymer chains and negative counter-ions from the electrolyte solution. The polymer produced by electrochemcial oxidation on the anode is hydrophilic owing to its salt-like character. By a simple electrochemical reduction such charged polymers may be reversibly converted into an uncharged state, which is hydrophobic. Electrochemical oxidation may then be used to convert the polymer back into the charged state.

By electrical modification, that is to say by partial oxidation or reduction, it is possible for the properties of this material to be repeatedly changed between the two states as often as may be required. By suitable locally restricted modification the information to be printed may be transferred to the polymer forming the printing image carrier in such a way that uncharged areas for the inked parts of the image and charged parts for the non-inked parts of the image are obtained.

A polymer suitable for the printing image carrier is for example polypyrrole which has the following structural formula:

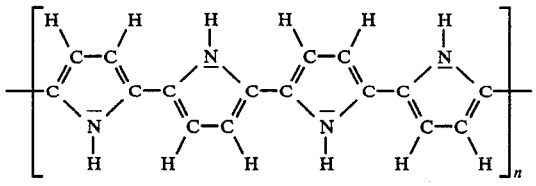

In this condition polypyrrole is hydrophobic. By anodic oxidation in an electrolyte the polymer is changed into a salt-like condition which, using ammonium bromide for example as an electrolyte, will have the following structure of a polymer unit:

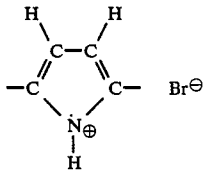

This oxidation converts the polypyrrole into a hydrophilic condition.

Monomers which may be converted by oxidative polymerisation into suitable polymers are more especially aromatic and heteroaromatic compounds such as thiophene, pyrrole, furan, indole, carbazole, benzothiophene and substitution products thereof, such as 3-alkyl- and more especially 3-methyl-, 3-alkoxy-, 3,4-dialkyloxy-, more especially 3-methoxy, 3,4-dimethoxy3-alkylthio-, and more especially 3-methylthio- 3,4-bis(-methylthio)-thiophene, -pyrrole, -furan, 2,2'-bithienyl, 2,2',5',2''-terthienyl, di-2-thienyl sulfide, -methane, 1,2-di-2-thienylethylene, aniline, substituted anilines, p-phenylenediamine, diphenylamine, 4,4'-diaminodiphenylmethane, -ether and -sulfide.

The conductive salts used are those which are inert under the conditions of the electrochemical reaction, and are more particularly inorganic conductive salts such as ammonium, lithium, and sodium tetrafluoroborates, perchlorates, sulfates and hydrogen sulfates; quaternary ammonium salts such as tetraalkyl ammonium perchlorates, tetrafluoroborates, hexafluorophosphates, hexafluoroantimonates, hexafluoroarsenates, methane sulfonates, toluene sulfonates, trifluoromethane sulfonates, trifluoroacetates; other alkyl sulfonates and sulfates such as lauryl sulfates and other anionic surfactants as for example alkyl carboxylates. These salts are dissolved in solvents which are also inert under the electrochemical reaction conditions, such as acetonitrile, 1,2-dimethoxyethane, methane sulfonic acid, dichloromethane, 1-methyl-2-pyrrolidone, nitrobenzene, nitroethane, nitromethane, dichloromethane, propionitrile, propylene carbonate, tetrahydrofuran, benzonitrile and sulfolane.

In order to perform the conversion the printing press is provided with integrated electrodes and means for applying electrolyte so as to act on the printing image carrier. The electrolyte more especially contains conductive salts which are inert under the conditions of the electrochemical reaction and are sufficiently soluble in the respective solvent used.

Furthermore the solvents may be organic solvents such as acetonitrile, nitromethane or water with conductive salts such as tetrabutyl ammonium salts and tetraethyl ammonium salts. In the case of aqueous solvents the use of alkali metal salts and alkyl sulfonates is preferred.

The first electrode may be in the form of the surface of the plate cylinder forming the printing image carrier or acting as a support therefor, the cylinder then either being suitably designed as a homogeneous or matrix-like electrode. The counter-electrode will then be a separate electrode provided in the press as an additional component, which, in accordance with the design of the first electrode, will be matrix-like or homogeneous in such a manner that one electrode is homogeneous and the other is matrix-like.

In the case of the use of a matrix-like first electrode the counter-electrode may be a metal cylinder with a slightly roughened surface, which is supported so as to be able to turn in electrolyte in a trough and serves for feeding the electrolyte. This function may also be performed by a counter-electrode with a screen-like casing but which however at the same time may have an effect cleaning the printing image carrier if the counter-electrode is so designed that electrolyte flowing through the screen may be forced at a sufficient pressure into the contact zone between the printing image carrier and the counter-electrode. This design offers the advantage that during modification or renewal of the printing image the printing image carrier is simultaneously freed of the ink used in the preceding printing run.

If a homogeneous first electrode is employed it is then possible to have one or more counter-electrodes. If more than one counter-electrode is used a reduction in the number of dots per unit area on the counter-electrode is possible.

If there are several counter-electrodes they may be in the form of electrode strips, which respectively have a breadth equal to the pitch or a whole number multiple thereof. A single electrode strip would also be conceivable, which is operated again for each succeeding new line as will appear from the account below.

The microprocessors needed for the renewal operation may be preferably arranged on the back side of the matrix electrode.

The invention also relates to a method of producing a printing image carrier which is able to be converted from a hydrophilic condition into a hydrophobic one and vice versa electrochemically or electrically and which has a polymer forming at least the surface of the printing image carrier is produced by an electrochemical reaction of a monomer in an electrolyte which contains the monomer and a conducting salt. The monomer may be an aromatic compound (that is to say a homoaromatic or a heteroaromatic compound) such as a thiophene compound, pyrrole, furan, indole, carbazole, benzothiophene or any of such compounds in a substituted form, dissolved in a solvent which is inert under the conditions of the electrochemical reaction. The solvent may for example be acetonitrile, nitrobenzene, dichloromethane, sulfolane or the like. The conductive salt may be an inorganic one, a quaternary ammonium salt, an alkyl sulfonate or an anionic surfactant which is inert under the conditions of the electrochemical reaction.

Preferably the electrodes used are inert under the reaction conditions and consist of a metal oxide at least on the surface. The electrodes may furthermore consist of carbon, more especially in the form of carbon fibers.

The invention will now be described in more detail with reference to the drawings.

LIST OF THE SEVERAL FIGURES OF THE DRAWINGS

DETAILED ACCOUNT OF WORKING EXAMPLES OF THE INVENTION

Figure 1:
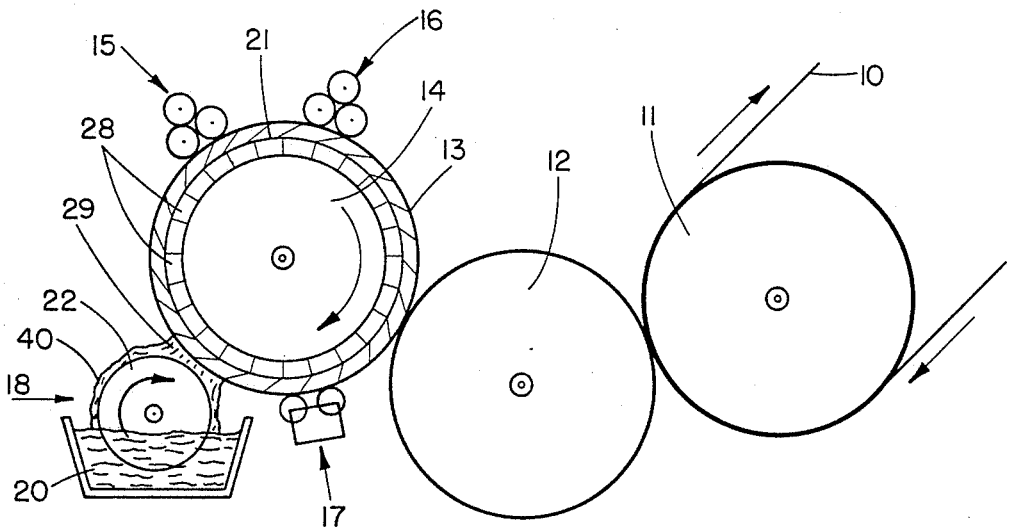
FIG. 1 shows a printing cylinder of a printing press in cross section.

In FIG. 1 the cylinders of a surface printing or offset litho printing press are shown. The paper 10 to be printed upon is drawn between an impression cylinder 11 and blanket cylinder 12 so that it accepts the ink from the blanket. The ink corresponding to the printed matter in the for of lettering or graphic material is taken by the blanket from a printing image carrier 13 which is held on a rotatable plate cylinder 14. The image on the printing image carrier 13 is formed by zones which are water repellent or hydrophobic and carry the ink, and zones which are hydrophilic and repel the ink so that they lead to the formation of non-inked parts of the image. The printing image carrier 13 is dampened by a damping unit 15 so that the hydrophobic areas are not wetted while the hydrophilic areas are wetted. The wetted surface then moves through the inking unit 16 to ink the hydrophobic areas, while the hydrophilic areas do accept any ink.

The printing image carrier 13 may be made of any material which is able to be changed over between a water accepting state and a water repelling state, such change being brought about in the one or the other direction by electrical or electrochemical pulses. Examples of such materials are electrically conductive polymers, which may be produced by electrochemical polymerization.

An electrically conductive polymer may for example be produced as follows:

0.05 to 0.1 mole/1 of monomer and 0.1 to 1 mole/1 of a conductive salt, as for instance an alkali metal salt, are dissolved in a solvent. By the application of a current density of 0.1 to 1 mA/sq cm a polymer is caused to be deposited on the anode.

The solvent used may be a medium polar organic solvent such as acetonitrile, nitromethane or dichloromethane, which are suitable for low polar monomers such as for instance thiophene and its derivatives and tetrabutylammonium or tetraethylammonium salts as the monomer and, respectively, the conductive salt. Other solvents are water or mixtures of water and organic solvents for which polar monomers such as pyrrole, aniline and derivatives and salts thereof, such as alkali metal salts or alkyl sulfonates are suitable. The conductive salts may basically be any salt which under the respective conditions of the electrochemical reaction is inert and is sufficiently soluble in the respectively used solvent. Furthermore for the electrochemical polymerization the conductive salt and the monomer in a dissolved state should be present in a sufficient quantity, while the polymer produced should be insoluble in the solvent utilized.

The printing image carrier 13 shown in FIG. 1 is in the form of an approximately 10 micron thick layer applied to the cylinder 14 carrying it. Preferably the layer is produced by electrochemical polymerization directly on the cylinder 14 which is adapted to serve as the anode. The layer may be applied to a substrate foil (as for example one of aluminum) and held taut on the cylinder 14 therewith.

The printing press furthermore includes a washing unit 17 and an electrolyte unit 18. After the end of a printing run the washing unit 17 and the electrolyte unit 18 are actuated without halting the press so that after the printing image carrier 13 on the cylinder 14 has given up its ink to the blanket on the cylinder 12 then has the last traces of ink may be washed therefrom by the washing unit 17. Then the printing image carrier is acted upon by the electric field of the electrolyte unit 18 in which areas of the printing image carrier 13 are reversed in order to produce a new image thereon, as will be described in what follows.

Figure 2:
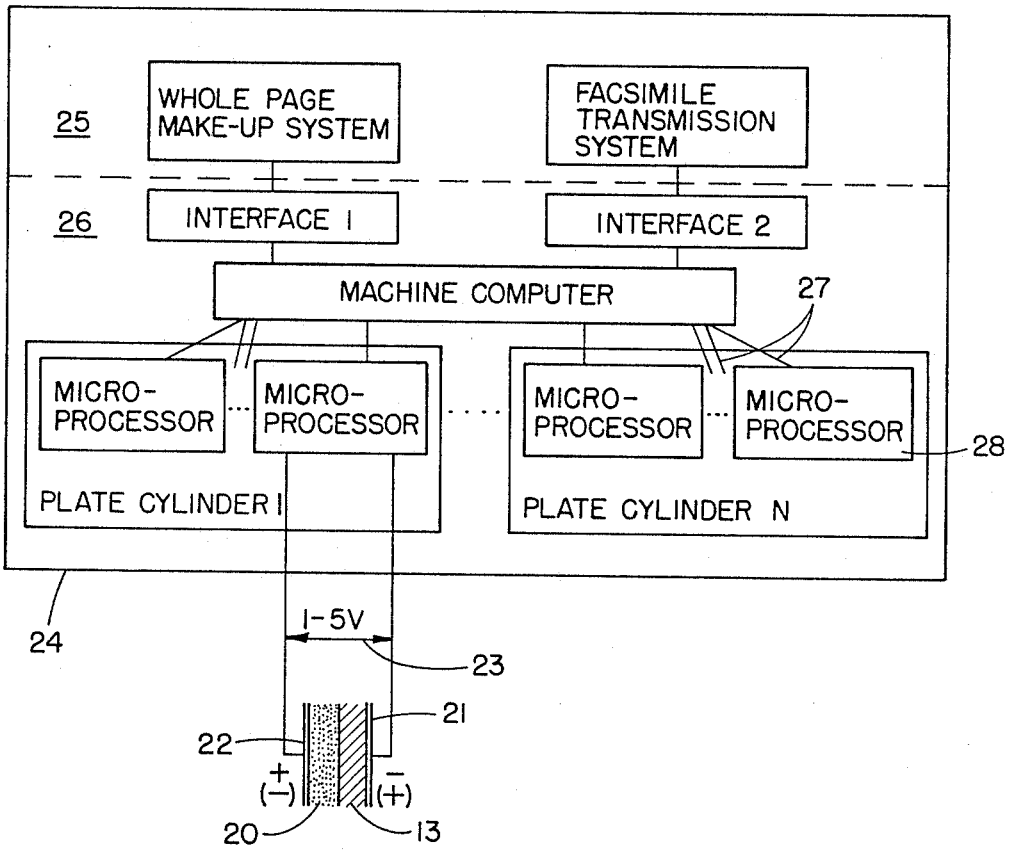
FIG. 2 is a block circuit diagram of the control unit.
Figure 4:
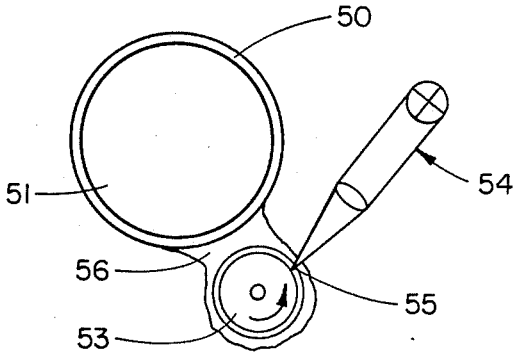
FIG. 4 shows a second working example of the invention.

FIG. 2 is a schematic view of the arrangement for reversing areas of the printing image carrier. The printing image carrier 13 is in contact with an electrolyte 20 and is located with the latter between a first electrode 21, which is constituted by the printing image carrier cylinder 13 and a counter-electrode 22, which as indicated in FIG. 1, is in the form of an electrode roller. The electrolyte 20 consists of a sufficient quantity of conductive salt in a solvent. The conductive salts and the solvents may be the substances used for the production of the polymer. Preferably water is used as the solvent for the conductive salt for the modification of the printing image carrier.

In order to initiate the electrochemical process there is an information transmitting unit 24, which comprises an information splitting system 25 in the editing department and a control unit 26 located on or in the press. In the editing department all the information to be printed is electronically stored by way of a so-called whole page make-up paging system or whole page layout system for printing a newspaper or magazines or is electronically encoded as part of the operation of a facsimile transmission system. This information is supplied via an interface to a machine computer which produces control signals 27 in accordance therewith. The control signals are fed to microprocessors 28 which supply voltage or current pulses 23 to the electrodes 21 and 22.

Dependent on the direction of the current the polymer forming the printing image carrier 13 is reversibly charged or discharged, that is to say a modification of the printing image carrier 13 is caused by reversing the voltage.

In order to be able to produce the hydrophobic parts of the printing image on the printing image carrier dots are produced with a screen pitch of for example 30 dots per cm as in newspaper printing or of 120 dots per cm for a magazine. Each of these dots has to be able to be independently produced in order to produce the gradation. For this purpose the surface of the electrode 21 located on the cylinder 14 is in the form of a matrix of electrode elements of which each corresponds to one dot.

Figure 3:
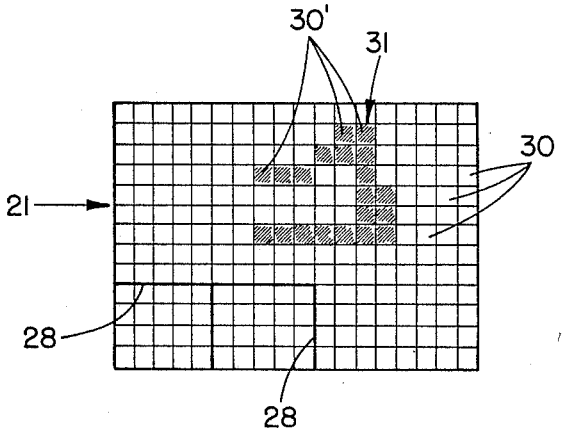
FIG. 3 shows a detail of the construction shown in FIG. 1.

FIG. 3 is a surface view with considerable magnification of the electrode matrix 21. For driving the individual electrode elements 30 there are corresponding microprocessors 28, each for driving a certain number of electrode elements 30. The microprocessors 28 are arranged in the printing image carrier cylinder 14 on the back side of the electrodes 21, as is shown in cross section in FIG. 1 and in FIG. 3 in thicker lines. For example it is possible for one square centimeter of dots to be driven by one microprocessor 28.

In order to produce an image 31 on the printing image carrier 13 the electode elements 30 (FIG. 3) are driven or not driven by way of the drive unit in a way dependent on whether the respective dot already has the state desired for a new image or not. The electrode elements 30 may be driven sequentially or line by line.

In the set-up shown in FIG. 1 the electrolyte 20 is supplied from a container through the counter-electrode roller 22, which is in the form of a homogeneous roller with a rough surface. The electrolyte may also be supplied by way of a separate supply means into the dot modification zone.

For dot modification, in which the electrolyte unit 18 is put into operation the counter-electrode roller 22 is rotated so that its rough surface entrains an electrolyte film 40 and conveys it into the gap 29 between the printing image carrier 13 and the counter-electrode 22.

In accordance with a modified form of the invention one electrode may have a screen-like outer cylindrical surface through which electrolyte is forced during the modification operation under sufficient pressure into the contact zone 29 so that ink is kept out of the gap. This makes it unnecessary to carry out a separate washing operation with a washing unit 17.

The arrangement and design of the homogeneous or matrix-like electrodes may be as desired. It is naturally possible for the electrode on the printing image carrier cylinder 14 to be homogeneous and for the counter-electrode 22 to be in the form of a matrix. In the latter case the counter-electrode may be a multipart one. If more than one counter-electrode is employed it is possible to reduce the dot density (i. e. the number of dots in a given area). It would also be possible for such a matrix electrode to be produced as an electrode strip with a breadth equal to one line of the dots in the dot pattern or a multiple thereof, or to have a row of electrodes with which the entire printing image carrier would be treated line by line as the printing image carrier 13 moves through the modification zone.

A further way of producing the matrix electrode is to use a homogeneous electrode, as for example a metal roller coated with a photoconductor. FIG. 5 shows a working example of such a design in which the cylinder 51 supporting the printing image carrier 50 is in the form of a homogeneous electrode, whereas the counter-electrode 52 has the function of the matrix electrode.

The counter-electrode consists of a homogeneous electrode casing, as for example of metal, which is coated with a photoconductor 53. The photoconductor is exposed to form an image along a line on the outer cylindrical surface parallel to the axis of rotation of the counter-electrode 52 by means of a ray source 54. The photoconductor 53 becomes conducting at the exposed points 55 so that when such a conducting point 55 enters the contact zone 56 with the printing image carrier cylinder 51 it is possible for the required current to flow between the printing image carrier cylinder electrode 51 and the counter-electrode 52 in order to modify the printing image carrier 50. The light source 54 is modulated in accordance with the information to be transferred so that the photoconductor 53 is modified during the short exposure time.

Preferably the photoconductor has the property of only maintaining the conductivity induced by the exposure for a short time but the conductivity should be preserved as far as the contact zone 56. After the line which is just to be transferred has left the contact zone 56 again, the conductive points 55 have to become non-conducting again in order to make possible renewed writing for the next rotation of the counter-electrode 52. The photoconductor may more especially be an organic one.

The desired switching properties to increased or additional values of the photoconductor 53 may be influenced by the incorporation of luminescent material therein so that the conductive state persists and is extended in time. Thermal treatment would also be possible such that the exposed points 57 would be more quickly rendered non-conducting after moving past the contact point 56. Furthermore the diameter of a drum-like counter-electrode 52 and the arrangement of the ray source 54 will be determined in accordance with the said increasing and incremental switching properties of the photoconductor selected.

We claim:

1. A printing press for surface printing comprising a printed image carrier having hydrophobic and hydrophilic areas corresponding to matter to be printed, means for changing over areas of such printed image carrier between hydrophobic and hydrophilic states in dots, said printed image carrier comprising a material able to be changed between over between said states by electrical operation, and means adapted to produce electrical operating signals for influencing selected areas of said printed image carrier to effect such change in state thereat.

2. The printing press as claimed in claim 1 comprising means for electrochemically changing said printed image carrier over between said states.

3. The printing press as claimed in claim 1 wherein said material is an electrically conducting polymer.

4. The printing press as claimed in claim 3 wherein said material is a polymer produced by the oxidative polymerization of an aromatic compound.

5. The printing press as claimed in claim 1 comprising electrodes associated with said printed image carrier able to be locally operated by operating signals for electrochemically influencing said printed image carrier dot by dot.

6. The printing press as claimed in claim 4 comprising means for the application of an electrolyte containing a conductive salt for electrochemical modification of said printed image carrier, said salt being inert under the condition of an electrochemical reaction occurring during said electrochemical modification.

7. The printing press as claimed in claim 1 wherein the said printed image carrier is in the form of a plate and said press comprises a plate cylinder on which said plate is mounted, said plate being connected to act as an electrode and furthermore a counter-electrode displaceably arranged in relation to said plate-cylinder for acting on said plate in electrolyte.

8. The printing press as claimed in claim 1 wherein the said printed image carrier is in the form of a plate and said press comprises a plate cylinder on which said plate is mounted, said plate cylinder being connected to act as an electrode and furthermore a counter-electrode displaceably arranged in relation to said plate-cylinder for acting on said plate in electrolyte.

9. The printing press as claimed in claim 5 wherein said electrodes are arranged so as to correspond to a pattern of dots, the press further comprising means for separately operating said electrodes.

10. The printing press as claimed in claim 9 wherein said electrode comprises a row of electrode elements connected to be operated line by line.

11. The printing press as claimed in claim 9 wherein one of the members in the group consisting essentially of a surface of the printed image carrier, the plate cylinder and the counter-electrode, is in the form of an electrode matrix.

12. The printing press as claimed in claim 7 wherein said counter-electrode is in the form of a rotatable cylinder adapted to feed electrolyte to the printed image carrier.

13. The printing press as claimed in claim 7 comprising means for forcing electrolyte into a zone in which areas of said printed image carrier are changed over between a hydrophilic and a hydrophobic state.

14. The printing press as claimed in claim 7 wherein said counter-electrode is coated with a photoconductor and said press further comprises a ray source for dotwise exposure of said photoconductor.

15. The printing press as claimed in claim 11 comprising microprocessors arranged on a rear side of said matrix electrode for operation of elements of said matrix.

* * * * *